United States Patent [19]

Baker

[11] 4,001,962

[45] Jan. 11, 1977

[54] CYLINDER-INDEXING MEANS FOR REVOLVERS

[75] Inventor: Richard L. Baker, Wallingford, Conn.

[73] Assignee: The Leisure Group, Inc., Los Angeles, Calif.

[22] Filed: Nov. 25, 1974

[21] Appl. No.: 526,719

[52] U.S. Cl. ..... 42/67; 42/65

[51] Int. Cl.[2] ..... F41C 19/00

[58] Field of Search ..... 42/67, 65

[56] References Cited

UNITED STATES PATENTS

| | | | |
|---|---|---|---|
| 391,213 | 10/1888 | Torkelson | 42/67 |
| 611,826 | 10/1898 | Wesson et al. | 42/67 |
| 2,733,529 | 2/1956 | Ruger | 42/67 |
| 2,958,151 | 11/1960 | Sefried II | 42/67 |
| 3,768,190 | 10/1973 | Ruger et al. | 42/65 |
| 3,918,189 | 11/1975 | Hartog | 42/67 |

*Primary Examiner*—Charles T. Jordan

*Attorney, Agent, or Firm*—St. Onge Mayers Steward & Reens

[57] ABSTRACT

A revolver in which the cylinder is indexed by the cylinder-indexing hand to a position just before the next chamber is in full alignment with the barrel where the corresponding cylinder notch partially overlaps the cylinder lock. The cylinder lock is provided with a cam-surface on its cylinder-engaging portion that engages the leading edge of the notch for camming the cylinder the rest of the way into its fully indexed position.

6 Claims, 7 Drawing Figures

CYLINDER-INDEXING MEANS FOR REVOLVERS

BACKGROUND OF THE INVENTION

The present invention relates to firearms of the type known as revolvers, and it relates more particularly to means for accurately indexing the cartridge-chamber cylinder thereof for successively aligning each chamber with the barrel.

A long-standing and well recognized problem in obtaining consistently accurate alignment of all of the chambers in the cylinder of a revolver is the need for extremely close manufacturing tolerances in various operations, such as machining the ratchet teeth on the cylinder by which it is rotated or forming the engagement surfaces on the cylinder hand or pawl that engages the teeth. Since even close tolerances can not invariably assure the accuracy required of quality revolvers, skilled hand-filing of the parts is usually necessary in the manufacture of a first-rate revolver. This obviously involves considerable expense.

It is an object of the present invention to provide a reliable system for indexing the cylinder without resorting to the skilled techniques of the gunsmith. Various proposals have been made in attempts to increase the accuracy with which the cylinder is indexed in order to align each chamber in the cylinder with the barrel, but when large-scale production is required, cost is an important factor and accuracy of alignment has usually suffered.

Some revolvers that are made on a large scale index well and are reliable as long as the trigger is pulled rapidly or the hammer cocked smartly, but if the shooter pulls the trigger slowly in order to improve his aim, the cylinder stop or lock may not engage properly before the cartridge is discharged, resulting in misalignment of the chamber with the barrel at the instant of discharge. It will be appreciated, moreover, that if a revolver is carefully designed and made in order to decrease the force required to pull the trigger in double-action and to make the trigger-pull as uniform as possible throughout the entire stroke of the trigger, smoother action and better aim can be achieved. Discriminating revolver users, such as policemen, will then tend to fire such guns more often in double-action, as opposed to the usual method, where greater accuracy of aim is desired, of first cocking the hammer by means of the cocking piece and then firing in single-action by pulling the trigger. Consequently, in quality revolvers of this type, it becomes mandatory that the cylinder stop or lock, as it is called hereinafter, be fully engaged with a cylinder notch before the hammer is released, so that accurate alignment of the cartridge with the barrel is assured when it is discharged.

SUMMARY OF THE INVENTION

In accordance with the present invention, the cylinder is indexed by first rotating it in the usual way with the cylinder hand to a position where the cylinder lock is partially, but not fully, aligned with the next notch in the periphery of the cylinder. The cylinder lock is provided on its edge with a cam-surface that faces generally in the direction of rotation of the cylinder, so that when the leading edge of the cylinder notch comes into contact with this cam-surface, the force exerted against it by the cylinder lock causes the cylinder to be rotated the small remaining distance for alignment of the next chamber with the barrel, at which point the lock becomes fully engaged with the notch.

The cylinder-indexing means thus includes ratchet means, such as the usual cylinder hand and ratchet wheel, for rotating the cylinder through most of its indexing movement until the leading edge of the next notch on the cylinder comes into engagement with the cam-surface on the cylinder lock. Means are provided for urging the cylinder lock into engagement with the notches so that once the leading edge of the cylinder notch comes into engagement with the cam-surface on the lock, the pressure of the lock against the edge of the notch will rotate the cylinder through the small remaining portion of its movement into full alignment of the notch and lock. The full indexing movement of the cylinder is accordingly accomplished by the cylinder lock as well as by the ratchet means.

By using a ratchet system in which the cylinder hand by-passes each tooth of the ratchet wheel after it has rotated the cylinder through a predetermined number of degrees of arc, the cylinder can be readily indexed by the hand so that the leading edge of each cylinder notch invariably comes into engagement with the cam-surface on the lock at the point that the hand starts to by-pass the ratchet tooth. The cylinder lock then takes over to complete alignment of the chamber with the barrel.

DETAILED DESCRIPTION OF THE PREFERRED EMBODIMENT

With the foregoing background and general summary of the invention in mind, reference is made to the accompanying drawings, in which FIG. 1 is a side view, partially broken away and partially in section, of a revolver incorporating the invention, the parts being shown in the positions they assume at the instant the gun is fired;

Figure 1:
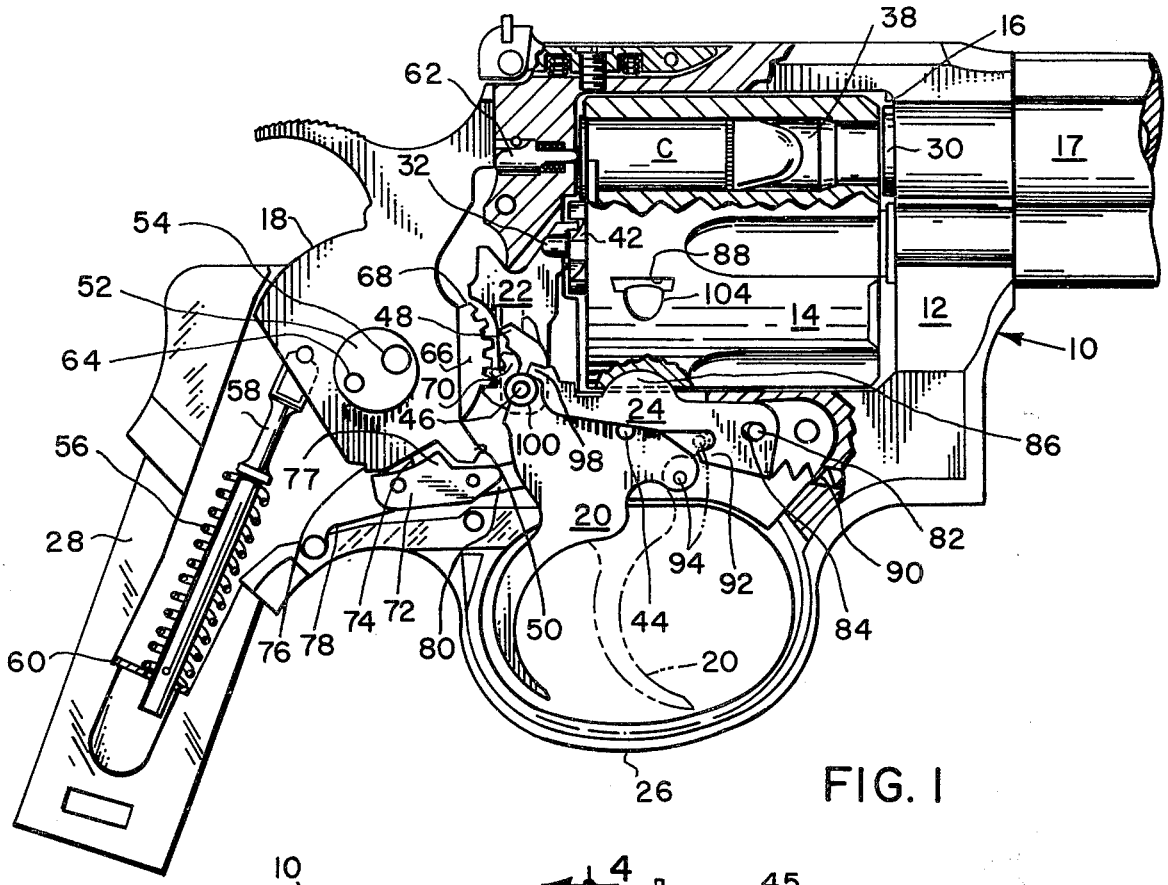

The revolver 10, which in this instance is designed for firing in either single-action or in double-action, consists basically of a frame 12, a chamber cylinder 14 rotatably mounted in a central opening 16 of frame 12, a barrel 17, a hammer 18, a trigger 20, an indexing pawl or hand 22 and a cylinder lock 24. Frame 12 includes a trigger-guard 26 and a tang-portion 28, on which the grip (not shown) is fastened. Barrel 17 is rigidly fastened to the front end of frame 12 and has a rear extension 30 that projects a short distance into the central opening 16 into close proximity with the front end-wall of cylinder 14.

Figure 2:
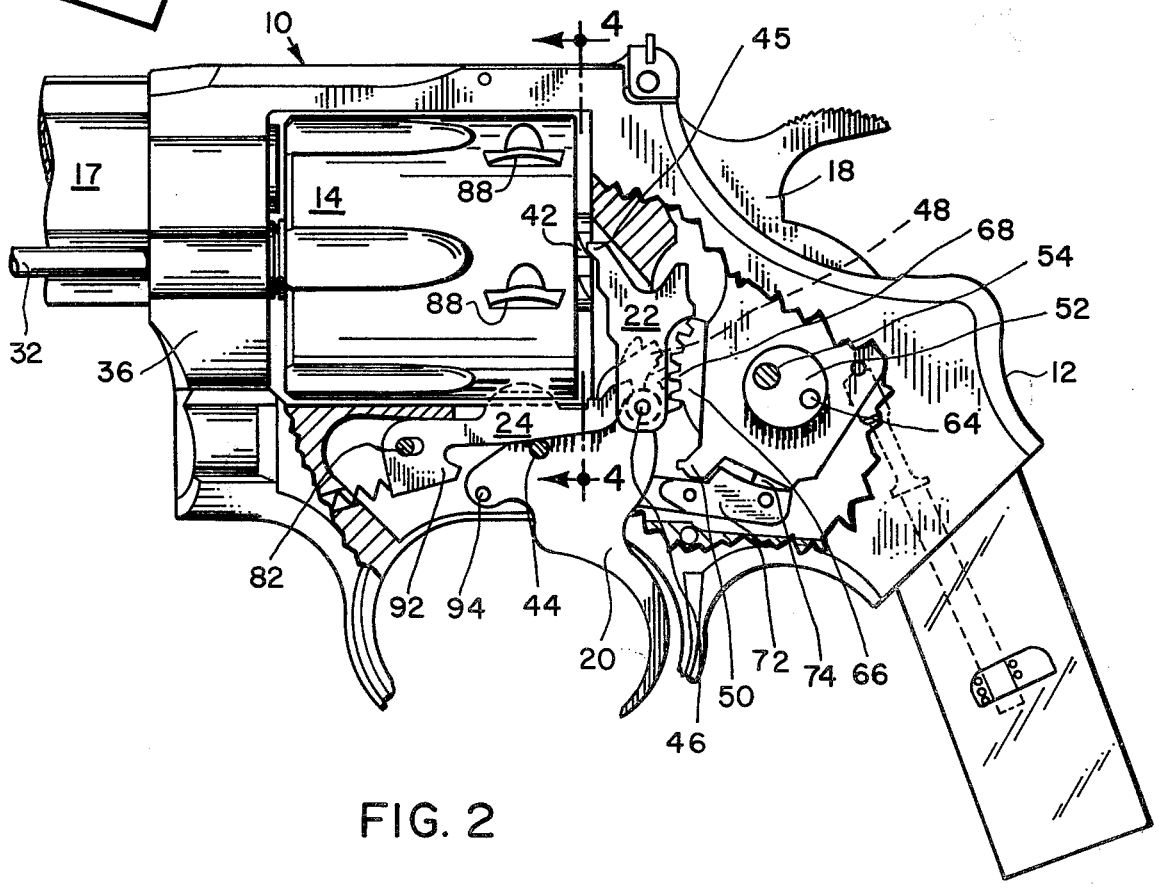
FIG. 2 is a view of the opposite side of the gun shown in FIG. 1, portions thereof being shown broken away and in section.
Figure 6:
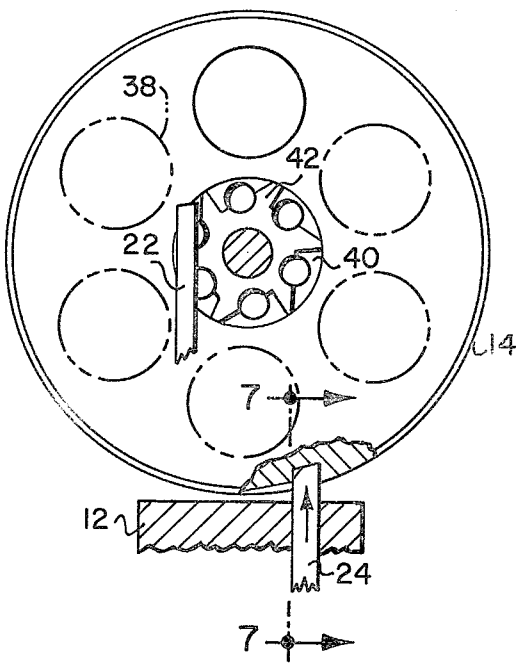
FIG. 6 is a view similar to FIGS. 4 and 5, but showing the cylinder locked and the uppermost chamber aligned with the barrel.
Figure 5:
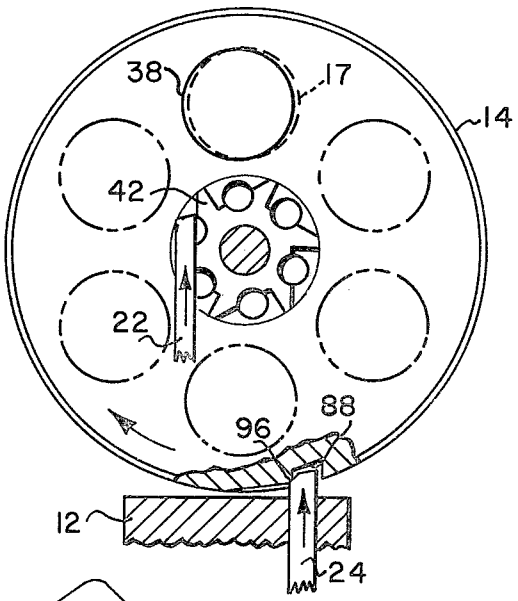
FIG. 5 is a view similar to FIG. 4, but showing the hand as it starts to by-pass the ratchet tooth.
Figure 4:
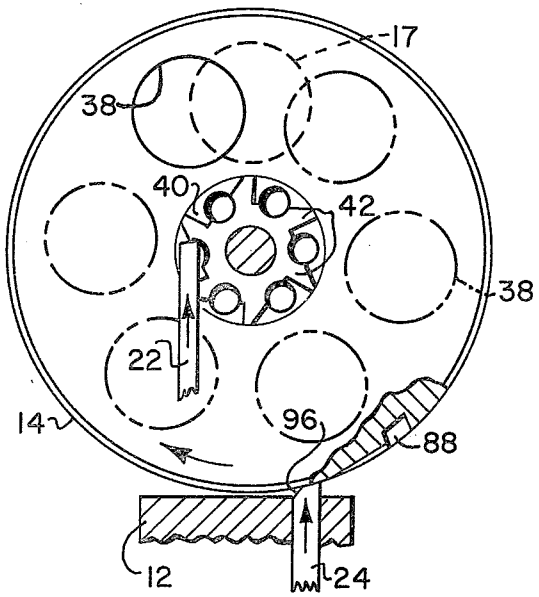
FIG. 4 is a more or less schematic view of the cylinder, hand and lock, looking toward the rear end of the cylinder as if on the line 4—4 of FIG. 2, showing the cylinder being indexed by the hand.
Figure 3:
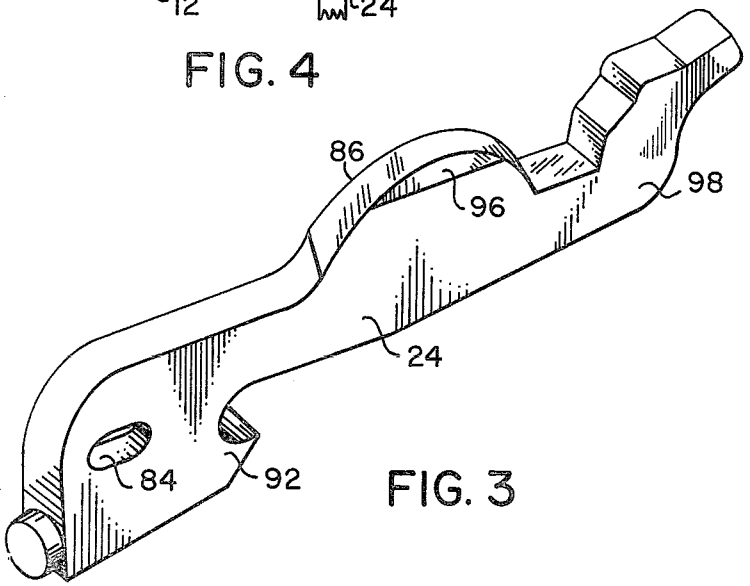
FIG. 3 is an enlarged perspective view of the cylinder lock.

Cylinder 14 is mounted on a spindle 32, the rear end of which protrudes a short distance from the rear face of cylinder 14 for engagement within a hole (not shown) in frame 12. Spindle 32 extends forward from cylinder 14 below the barrel 17 and is journaled in a cylinder crane 36 (FIG. 2), by which it may be swung out laterally of frame 12 in order to reload the chambers 38. A ratchet wheel 40 (FIGS. 4–6) is mounted concentrically on cylinder 14 at its rear end for rotation therewith and has a plurality of radially disposed teeth 42 equal in number to the chambers 38. Each tooth 42 is engaged by the indexing hand 22 in sequence for rotating cylinder 14 (in this instance clockwise as shown in FIGS. 4–6) in order to index the next chamber toward alignment with the barrel 17.

Trigger 20 is pivoted on the frame 12 about a pivot pin 44 between its normal position of rest shown in phatom-lines in FIG. 1 and a retracted or fired position shown in full-lines. Cylinder hand 22 is pivotally connected at its lower end to a rearwardly and upwardly projecting portion of trigger 20 by a pivot pin 46 and is resiliently urged forward at its upper end by means of a spring (not shown) for engagement of its nose 45 with ratchet teeth 42. Each time trigger 20 is retracted, hand 22 is raised vertically, as illustrated in FIGS. 4–6, causing cylinder 14 to rotate through an arc corresponding approximately to the angle at which chambers 38 are disposed to each other about the axis of the cylinder. A conventional sear-nose 48 is provided on trigger 20 for cocking engagement with a cocking foot 50 on hammer 18 for cocking the hammer in single-action.

In this instance, hammer 18 is pivoted on a circular eccentric plate 52, which in turn pivots about a hammer pin 54 mounted in the frame 12. The main hammer spring 56 is held in compression between a shoulder on the strut 58 and an apertured plate 60 seated within the tang-portion 28 of frame 12. As shown in FIG. 1, hammer 18 has just been driven by the main spring 56 from its cocked position into engagement with the firing pin 62 to fire the cartridge C in the uppermost chamber 38.

Eccentric plate 52 is rigidly fastened by means of a pin 64 to a hammer gear-plate 66 disposed within a narrow opening in the lower portion of hammer 18 for pivotal movement with eccentric plate 52 about the hammer pin 54. Gear-teeth 68 on gear-plate 66 mesh with a corresponding gear-segment 70 fixed to trigger 20 adjacent its sear-nose 48. Consequently, each time trigger 20 is retracted, hammer gear-plate 66 and eccentric plate 52 are pivoted in unison in a counterclockwise direction as viewed in FIG. 1 to the position shown. Because hammer pin 54 is off-set from the center of the circular plate 52 rotation of this member causes the hammer 18 to be shifted bodily relative to the hammer pin 54. Thus, when trigger 20 is released by the person firing the gun from the position in which it is shown in FIG. 1, it will return to its normal position of rest shown in phantom lines under the force exerted on it by the hammer spring 56 through hammer 18 and gear-plate 66. At the same time, eccentric plate 52 is pivoted clockwise (FIG. 1) about hammer pin 54, causing the hammer 18 to shift upward in the frame 12 to a position in which the nose portion of the hammer is located above the firing pin 62 and out of registry therewith. Consequently, the hammer can strike the firing pin only when the trigger is retracted.

In order to fire the revolver in double-action, a sear 72 is provided for locking the gear-plate 66 to the hammer when the trigger is pulled. Sear 72 is pivoted to a depending arm 74 on gear-plate 66 for engagement with a sear-notch 76 on the lower edge of hammer 18 when both the hammer and the trigger are in their normal positions of rest. Thus, upon release of the trigger after the gun has fired, gear-plate 66 is pivoted clockwise from the position shown in FIG. 1, carrying the sear 72 with it until the nose-portion 77 on the sear engages with the notch 76 in the hammer. Sear 72 is resiliently urged toward engagement with hammer 18 by a torsion spring 78 mounted on frame 12.

When the trigger is again pulled in double-action (i.e. without first cocking the hammer), trigger-gear 70 pivots the gear-plate 66 counterclockwise, and this in turn cocks the hammer through engagement of sear 72 with the sear-notch 76. Shortly before the trigger reaches its fully retracted position, a finger 80 extending forwardly from sear 72 engages a fixed abutment (not shown), pivoting sear 72 clockwise on the gear-plate 66, so that its nose 77 is withdrawn from engagement with sear-notch 76. Hammer 18 is then free to pivot on eccentric-plate 52 under the pressure of main spring 56 independently of gear-plate 66.

Cylinder lock 24 performs the usual function of locking the cylinder in each of the positions to which it is indexed where each cartridge-chamber 38 is aligned in sequence with barrel 17 for discharge of a cartridge. To this end, lock 24 is mounted for both pivotal movement and sliding movement on a pin 82 fixed in frame 12, which passes through an elongated slot 84 at the forward end of the lock member. On the upper side of lock 24 intermediate its ends is a semicircularly shaped cylinder-engaging portion 86, which fits into each of the usual cylinder notches 88 in sequence. Notches 88 are equally spaced circumferentially about the periphery of cylinder 14 in the usual manner and are each disposed with respect to its corresponding cartridge chamber 38, such that when the top-most chamber is exactly aligned with the barrel 17, as shown in FIG. 6, cylinder lock 24 is fully engaged within one of notches 88.

Lock 24 is spring-urged by means of a coil spring 90 for engagement of its cylinder-engaging portion 86 with the cylinder. In addition, a rearwardly facing hook 92 is provided on the underside of lock 24 for interengagement with a lug 94 projecting laterally from the forward end of trigger 20. When the trigger is in its normal position of rest (phantom-line position), lug 94 is disposed above the tip of hook 92, so that when the trigger is pulled, lug 94 draws the lock 24 downward retracting its cylinder-engaging portion 86 from the notch 88, so that cylinder 14 can be rotated by means of the cylinder hand 22. When the trigger returns to its forward position, lug 94 contacts an inclined surface on the underside of hook 92, camming the lock lengthwise on pin 82 and permitting lug 94 to return to its initial position above the tip of the hook without again retracting the lock 24 from engagement with the next cylinder notch 88.

Referring now more particularly to FIGS. 3 through 7, it will be noted that the cylinder lock 24 is provided on the upper edge of its cylinder-engaging portion 86 with a cam-surface 96, which is desirably a plane inclined surface or wedge. Cam-surface 96 faces in the general direction of rotation of cylinder 14 and is inclined to the radius of the cylinder for engagement with the leading edge of each cylinder notch 88. Thus, when the leading edge of the notch comes in contact with the cam-surface 96, as shown in FIG. 5, the pressure exerted by lock 24 against it results in a force directed well to one side of the center of rotation sufficient to rotate cylinder 14 in the same direction that it is rotated by the hand 22. Consequently, in accordance with the present invention, the cylinder hand 22 does not need to rotate the cylinder completely into registry with each notch 88, but can disengage the cylinder as soon as the leading edge of each of said notches comes into engagement with the cam-surface 96 on the cylinder lock. The upward pressure exerted by lock 24 then causes the cylinder to be rotated the rest of the way until lock 24 is fully engaged within the notch. This sequence is well illustrated in the series of views shown in FIGS. 4–6.

In FIG. 4 the cylinder hand 22 is shown engaging one of the ratchet teeth 42 and is rotating the next chamber 38 shown in full lines toward alignment with the barrel 17 (illustrated by the broken-line circle at the top of the cylinder). FIG. 5 shows the cylinder rotated to the position at which the leading edge of the next notch 88 contacts the cam-surface 96 on lock 24 with the corresponding chamber 38 almost, but not quite, in alignment with the barrel 17. At this point the cylinder hand 22 starts to by-pass the ratchet tooth 42 and, therefore, no longer exerts any force on the cylinder for rotating it. However, since the cam surface 96 of cylinder lock 24 now engages the edge of notch 88, the upward pressure of lock 24 against the cylinder will rotate it from the position shown in FIG. 5 to the position of full-alignment shown in FIG. 6. Accordingly instead of relying on the cylinder hand for precise alignment of the chambers with the barrel as in prior revolvers, the hand 22 simply rotates the cylinder until the leading edge of the next cylinder notch engages the cam-surface 96 on the lock 24, at which point the hand starts to by-pass the corresponding ratchet tooth. The lock 24 then takes over and drives the cylinder through its final increment of rotation as the lock enters the cylinder notch. It will be apparent from the foregoing that because the hand can start to by-pass the ratchet tooth anywhere along the cam-surface 96 on the cylinder lock 24, manufacturing tolerances for the cylinder hand, as well as for each of the ratchet teeth and cylinder notches can be much greater than has been necessary heretofore for quality revolvers.

While the cylinder-lock spring 90 may be strong enough to drive cylinder lock 24 against the cylinder 14 with sufficient force to ensure rotation of the cylinder into alignment, it is not desirable to make this spring too strong because of the initial resistance to retraction of the trigger that is exerted by spring 90 as the lug 94 withdraws the lock 24 from engagement with cylinder 14 during the early portion of the trigger stroke for releasing the cylinder so that it can be indexed to its next position. Cylinder lock 24 is therefore designed to be positively driven into engagement with each cylinder notch 88 during the final portion of the trigger stroke.

To this end, lock 24 is provided with an extension 98 that projects rearwardly of the notch-engaging portion 86 and then upwardly for engagement on its underside by a cylindrical bushing 100 on one end of pin 46 that projects laterally of trigger 20. When trigger 20 is in its forward position, bushing 100 is spaced below the extension 98 and does not come in contact with it until just before the end of the trigger stroke after the cylinder has been rotated by the cylinder hand approximately to the position shown in FIG. 5. During the final movement of the trigger, bushing 100 drives the cylinder lock 24 upward, rotating the cylinder 14 into its precise position of alignment, then locking it in place for firing.

From the foregoing it will be apparent that the trigger can be operated as slowly or as rapidly as desired, while still ensuring that the cylinder will be fully indexed and locked each time the trigger is pulled. Thus, no matter how slowly the cylinder is rotated by the hand 22, it will first be driven by the hand to the area in which the leading edge of the next cylinder notch 88 contacts the cam-surface 96 on cylinder lock 24, and then further movement of the cylinder for alignment of the fresh chamber with the barrel is effected either by the pressure of spring 90, or by the bushing 100 on the trigger during the final increment of travel of the trigger after the hammer is released.

Figure 7:
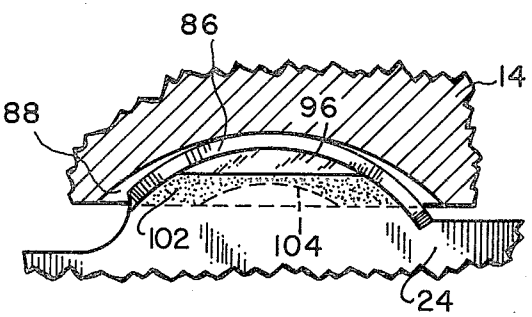
FIG. 7 is an enlarged sectional detail of the engaging portion of the cylinder lock taken on the line 7—7 of FIG. 6.

In order to ensure that cylinder 14 is positively locked against rotation in either direction once it has been indexed, it is important that both walls of each cylinder notch 88 have flat or surface engagement with both sides of the cylinder lock. In other words when the cylinder lock is fully engaged with each notch, the cam-surface 96 should be disposed completely within the notch, as shown in FIG. 6, so that after the trigger has been released the lock 24 can not be cammed down by the cylinder in the event that an external force is applied to the cylinder tending to rotate it in a counter-clockwise direction. Thus, as illustrated in FIG. 7, flat engagement of the lock 24 and notch 88 is provided in the stippled area 102 below the cam-surface 96 and above the thumb-nail groove 104 in the approach to notch 88. Flat contact is of course obtained between the opposite side of the notch-engaging portion of lock 24 and the other wall of the notch, thereby not only preventing rotation of the cylinder in that direction once the lock is engaged, but also stopping rotation of the cylinder in the usual manner if the cylinder is rotated so rapidly that the lock does not have time to enter the notch.

What is claimed is:

1. In a revolver having a frame, a barrel mounted on said frame, a cylinder with a plurality of cartridge chambers disposed at equal angles about its central axis, said cylinder being mounted on said frame for rotation about said axis, means for indexing said cylinder in order to move each chamber in sequence into alignment with said barrel, said cylinder having a plurality of equally spaced notches corresponding in number to said chambers disposed circumferentially about its periphery, a cylinder lock mounted on said frame for reciprocal movement into and out of locking engagement with said notches and means for urging said cylinder lock into engagement with said notches, said notches being disposed relative to said chambers such that when said lock is fully engaged within one of said notches a corresponding one of said chambers is aligned with said barrel, the improvement in said cylinder-indexing means comprising ratchet means for rotating said cylinder in sequence through a predetermined arc, said indexing means further including a cam-surface on said cylinder lock disposed for engagement with the leading edge of each of said notches, said cylinder being rotated by said ratchet means through said predetermined arc to a position at which said cam-surface engages the leading edge of each of said notches in sequence, said cam-surface facing in the general direction of rotation of said cylinder and being inclined at an angle to the radius of said cylinder at said leading edge such that upon engagement of said cam-surface by the leading edge of any one of said notches, said cylinder is rotated by said means urging said cylinder lock into engagement with said notches until said lock is fully registered with said one notch.

2. The improvement in cylinder-indexing means for revolvers as defined in claim 1, wherein said cam-surface comprises a plane surface inclined to a radius of said cylinder.

3. The improvement in cylinder-indexing means for revolvers as defined in claim 2, wherein said lock and each of said notches have surface engagement with each other on both sides when said lock is fully engaged within each of said notches.

4. The improvement in cylinder-indexing means for revolvers as defined in claim 1, wherein said ratchet means comprises a ratchet wheel concentrically disposed on said cylinder and having a plurality of teeth equal in number to said cartridge chambers and a cylinder hand mounted on said frame for reciprocal movement into and out of operating engagement with said teeth, each of said teeth being formed such that during each cocking cycle of the revolver said hand engages one of said teeth and rotates it through said predetermined arc until said one tooth moves out of the path of said hand permitting said hand to by-pass said tooth while continuing its motion in the same direction, said ratchet means and cylinder lock being constructed and arranged such that as said hand starts to by-pass each of said ratchet teeth, the leading edge of one of said notches is disposed for engagement by said cam-surface on said lock.

5. The improvement in cylinder-indexing means for revolvers as defined in claim 1, wherein said means for urging said cylinder lock into engagement with said notches includes means for engaging said cylinder lock and positively driving it toward said cylinder after said cylinder has been rotated to the position at which said cam-surface engages the leading edge of each said notch.

6. The improvement in cylinder-indexing means for revolvers as defined in claim 5, wherein said means for positively driving said cylinder lock toward said cylinder comprises an engagement lug on said trigger disposed such that it is normally out of engagement with said cylinder lock and is moved into engagement therewith at the end of the trigger stroke just prior to discharging the gun.

* * * * *